US008276261B2

(12) United States Patent
Baba

(10) Patent No.: US 8,276,261 B2
(45) Date of Patent: Oct. 2, 2012

(54) TUBE EXPANDING APPARATUS

(75) Inventor: Yoshihiro Baba, Tokyo (JP)

(73) Assignee: Hidaka Seiki Kabushiki Kaisha, Tokyo (JP)

( * ) Notice: Subject to any disclaimer, the term of this patent is extended or adjusted under 35 U.S.C. 154(b) by 384 days.

(21) Appl. No.: 12/761,146

(22) Filed: Apr. 15, 2010

(65) Prior Publication Data

US 2010/0263202 A1 Oct. 21, 2010

(30) Foreign Application Priority Data

Apr. 16, 2009 (JP) ..... 2009-099721

(51) Int. Cl.
*B21D 39/20* (2006.01)
*B21D 53/08* (2006.01)

(52) U.S. Cl. ..... 29/727; 29/270; 29/278; 29/276; 29/890.44; 72/370.06; 72/370.07; 72/370.08; 72/393

(58) Field of Classification Search ..... 29/726, 29/890.044, 727, 255, 270, 278; 72/370.06–370.08, 72/393
See application file for complete search history.

(56) References Cited

U.S. PATENT DOCUMENTS

| | | | | |
|---|---|---|---|---|
| 2,447,909 | A * | 8/1948 | Hunziker | 72/318 |
| 3,495,301 | A * | 2/1970 | Larsen et al. | 425/392 |
| 4,858,305 | A * | 8/1989 | Gray et al. | 29/727 |
| 5,806,173 | A * | 9/1998 | Honma et al. | 29/727 |
| 7,117,584 | B2 * | 10/2006 | Nakadeguchi et al. | 29/727 |
| 7,578,161 | B1 * | 8/2009 | Sizemore | 72/479 |
| 2004/0211056 | A1 * | 10/2004 | Nakadeguchi et al. | 29/727 |
| 2010/0011833 | A1 * | 1/2010 | Sizemore | 72/370.06 |
| 2010/0263202 | A1 * | 10/2010 | Baba | 29/727 |
| 2011/0138872 | A1 * | 6/2011 | Baba | 72/370.08 |

FOREIGN PATENT DOCUMENTS

| | | | |
|---|---|---|---|
| JP | 52-34839 | U | 3/1977 |
| JP | 07-276115 | A | 10/1995 |
| JP | 9-99334 | A | 4/1997 |
| JP | 2002-059305 | A | 2/2002 |

* cited by examiner

*Primary Examiner* — Derris Banks
*Assistant Examiner* — Kaying Kue
(74) *Attorney, Agent, or Firm* — Birch, Stewart, Kolasch & Birch, LLP

(57) ABSTRACT

In a state where the expanded protruding portion of the heat-exchanging tube, which has been expanded inside a grip portion of a chucking sleeve whose diameter has been reduced by a clamp bushing, is gripped by the grip portion, a tube expanding billet is inserted into a yet-unexpanded part of the heat-exchanging tube to cause tube expansion. When doing so, a guide portion, which is formed on a flare punch and has the same diameter as the maximum outer diameter of the tube expanding billet, is inserted inside the expanded protruding portion of the heat-exchanging tube gripped by the grip portion.

8 Claims, 8 Drawing Sheets

TUBE EXPANDING APPARATUS

CROSS-REFERENCE TO RELATED APPLICATION

This application is based upon and claims the benefit of priority of the prior Japanese Patent Application No. 2009-99721, filed on 16 Apr. 2009, the entire contents of which are incorporated herein by reference.

FIELD

The present invention relates to a tube expanding apparatus.

BACKGROUND

When manufacturing a heat exchanger used for example in a domestic air conditioner, a tube expanding apparatus is used to expand a heat-exchanging tube that passes through a fin layer, in which a plurality of fins are stacked, so as to integrate the fins and the heat-exchanging tube.

With this type of tube expanding apparatus, in some cases a so-called "avec" phenomenon occurs where the fins become tightly attached to one another due to the heat-exchanging tube shrinking in the length direction when the tube is expanded.

To prevent this "avec phenomenon", as one example, Patent Document 1 described below proposes a tube expanding apparatus that uses the chucking apparatus depicted in FIG. 8 to grip a protruding portion of the heat-exchanging tube that protrudes from the fin layer and expands the heat-exchanging tube to integrate the tube and the fins.

With a tube expanding apparatus that is equipped with the chucking apparatus depicted in FIG. 8, the protruding portion of a heat-exchanging tube 104 that passes through a fin layer 102, in which fins 100, 100 are stacked, and protrudes from one side of the fin layer 102 is inserted inside a grip portion 106*a* of a chucking sleeve 106 whose outer circumferential surface is squeezed using a clamping sleeve 109. A cylindrical inner sleeve 108, which is formed of a spring member or the like so as to be elastic, is inserted into the protruding portion of the heat-exchanging tube 104.

A tube expanding billet 112 that is attached onto a front end of a mandrel 110 is inserted into the protruding portion of the heat-exchanging tube 104 so that the protruding portion of the heat-exchanging tube 104 is expanded via the inner sleeve 108. The outer circumferential surface of the expanded protruding portion of the heat-exchanging tube 104 that has been expanded in this way is gripped by the inner wall surface of the grip portion 106*a* of the chucking sleeve 106.

After this, the expanded protruding portion remains gripped by the grip portion 106*a* of the chucking sleeve 106 and a yet-unexpanded part of the heat-exchanging tube 104 is expanded by the tube expanding billet 112, thereby integrating the heat-exchanging tube 104 and the fins 100.

Patent Document 1
Japanese Laid-Open Patent Publication No. H09-99334

SUMMARY

According to a tube expanding apparatus equipped with the chucking apparatus depicted in FIG. 8, it is possible to prevent the "avec phenomenon" whereby the fins become tightly attached to one another due to the heat-exchanging tube shrinking in the length direction when the tube is expanded.

However, with the chucking apparatus depicted in FIG. 8, after the tube expanding billet 112 has passed the protruding portion of the heat-exchanging tube 104, the cylindrical inner sleeve 108 that is formed of a spring member or the like so as to be elastic will return to its original thickness.

This means that the inner wall surface of the expanded protruding portion of the heat-exchanging tube 104 will become released, resulting in the risk of a fall in the diameter of the expanded protruding portion of the heat-exchanging tube 104 due to spring-back.

Also, since a squeezing force is applied onto the outer circumferential surface of the expanded protruding portion of the heat-exchanging tube 104 by the grip portion 106*a* of the chucking sleeve 106, there is the risk of deformation of the expanded protruding portion of the heat-exchanging tube 104.

When the diameter of the protruding portion of the heat-exchanging tube 104 that has been expanded falls or such portion becomes deformed, there is a drop in the force with which the expanded protruding portion of the heat-exchanging tube 104 is gripped by the chucking sleeve 106 and the inner sleeve 108.

Also, since the inner sleeve 108 inserted into the protruding portions of heat-exchanging tubes 104 repeatedly comes into direct contact with the tube expanding billet 112, there is the risk of the inner sleeve 108 becoming partially torn. When this happens, broken fragments of the inner sleeve 108 become lost inside one of the heat-exchanging tubes 104 that have been expanded. Since it is extremely difficult to discover and remove such fragments, the produced heat exchanger is treated as defective.

For this reason, it is an object of the present invention to provide a tube expanding apparatus that solves the problem with a conventional tube expanding apparatus that is equipped with a chucking apparatus where there is the risk of a drop in the force with which an expanded protruding portion of an expanded heat-exchanging tube is gripped, and includes a chucking apparatus that is capable of reliably gripping the expanded protruding portion of an expanded heat-exchanging tube.

As a result of a thorough investigation to solve the problems described above, the present inventors found that by carrying out tube expansion inside a grip portion of a chucking sleeve and inserting a guide portion that supports an inner wall surface of an expanded protruding portion into the expanded protruding portion of the heat-exchanging tube gripped by the grip portion, it is possible to prevent deformation of the expanded protruding portion of the heat-exchanging tube, such as deformation due to the squeezing force of the grip portion of the chucking sleeve.

To solve the problems described above, one aspect of the present invention is a tube expanding apparatus that places an outer circumferential surface of a maximum diameter portion of a tube expanding billet, which has been inserted into a heat-exchanging tube that passes through a fin layer in which a plurality of fins have been stacked, in direct contact with an inner wall surface of the heat-exchanging tube to expand the heat-exchanging tube and thereby integrate the heat-exchanging tube and the fins, the tube expanding apparatus being equipped with a chucking apparatus including: a chucking sleeve with a grip portion that grips an outer circumferential surface of an expanded protruding portion of the heat-exchanging tube which protrudes from one side of the fin layer and has been expanded by the tube expanding billet, wherein a diameter of the grip portion is capable of being reduced by a squeezing force that acts upon an outer circumferential surface of the grip portion; and a clamp bushing that is provided so as to be capable of sliding along the outer circumferential surface of the chucking sleeve in one of a direction where the grip portion of the chucking sleeve is squeezed so as to grip the expanded protruding portion of the heat-exchanging tube and a direction where squeezing by the grip portion of the chucking sleeve is released to stop the expanded protruding portion from being gripped, wherein the tube expanding apparatus is further equipped with: an insertion unit that expands the heat-exchanging tube and thereby integrates the fins and the heat-exchanging tube by inserting the tube expanding billet into a yet-unexpanded part of the heat-exchanging tube in a state where the expanded protruding portion of the heat-exchanging tube that has been expanded inside the grip portion of the chucking sleeve whose diameter has been reduced by the clamp bushing is gripped by the grip portion of the chucking sleeve; and a flare punch that is provided so as to be movable along the mandrel and has a flare forming portion formed on a front end portion thereof, the flare forming portion forming a flare portion on the expanded protruding portion of the heat-exchanging tube after gripping by the grip portion of the chucking sleeve has been released in a state where expansion of the heat-exchanging tube by the tube expanding billet has been completed, and wherein a guide portion, which has an equal diameter to the maximum outer diameter of the tube expanding billet and is inserted into the expanded protruding portion of the heat-exchanging tube inside the grip portion of the chucking sleeve so as to support an inner wall surface of the expanded protruding portion, is formed closer to a front end of the flare punch than the flare forming portion.

The chucking apparatus provided in a conventional tube expanding apparatus operates as follows. Inside the grip portion of the chucking sleeve whose diameter has been reduced by the clamp bushing, the expanded protruding portion of the heat-exchanging tube is expanded by the tube expanding billet so that the expanded protruding portion is gripped by the grip portion of the chucking sleeve. When the tube expanding billet has passed however, the inner wall of the expanded protruding portion is released.

This means that the diameter of the expanded protruding portion of the heat-exchanging tube may fall due to spring-back and/or the expanded protruding portion may become deformed due to the squeezing force applied by the grip portion of the chucking sleeve.

However, the chucking apparatus used in the tube expanding apparatus according to the present invention as follows. Inside the grip portion of the chucking sleeve whose diameter has been reduced by the clamp bushing, the expanded protruding portion of the heat-exchanging tube is expanded by the tube expanding billet so that the expanded protruding portion is gripped by the grip portion of the chucking sleeve. However, after the tube expanding billet passes, a guide portion, which is formed on a front end portion of the flare punch and has a same diameter as the maximum outer diameter of the tube expanding billet, is inserted into the expanded protruding portion.

This means that the inner wall surface of the expanded protruding portion of the heat-exchanging tube that has been passed by the tube expanding billet is supported by the guide portion of the flare punch, which makes it possible to prevent a fall in diameter due to spring-back and deformation due to the squeezing force applied by the grip portion of the chucking sleeve.

Also, since the heat-exchanging tube is expanded by bringing the outer circumferential surface of the maximum diameter portion of the tube expanding billet into direct contact with the inner wall surface of the heat-exchanging tube, there is no inserted component that comes into contact with the tube expanding billet as with a conventional tube expanding apparatus, thereby eliminating the risk of fragments of such inserted component becoming lost inside the heat-exchanging tube.

DESCRIPTION OF EMBODIMENTS

Figure 1:
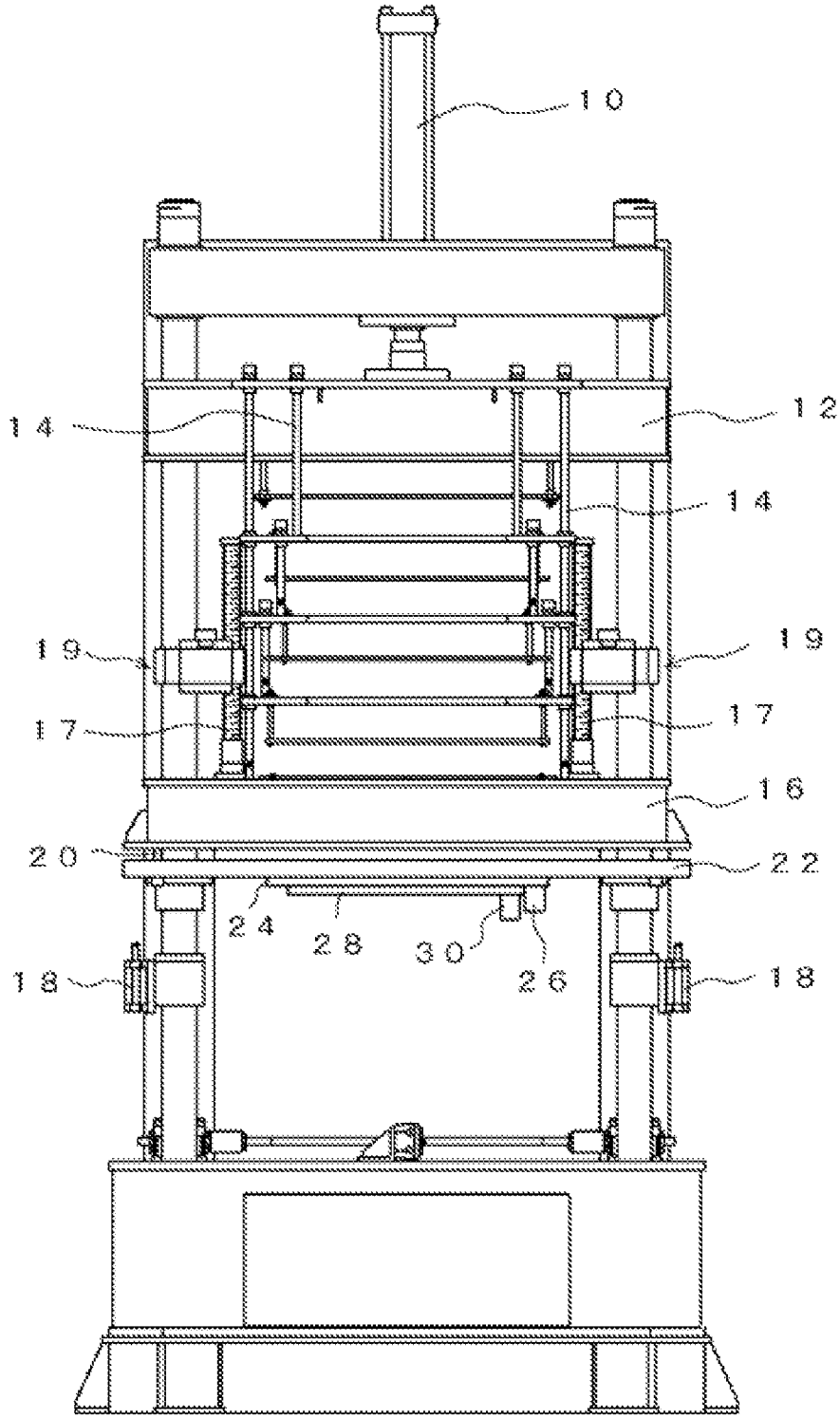
FIG. 1 is a front view depicting one example of a tube expanding apparatus according to the present invention.

One example of a tube expanding apparatus according to the present invention is depicted in FIG. 1. The tube expanding apparatus depicted in FIG. 1 includes a pressing plate 12 that is provided so as to be capable of being raised and lowered by a cylinder apparatus 10 as a driving means, a flare platform 16 that is suspended from the pressing plate 12 by suspending members 14, 14, a stripper platform 22 that is suspended from the flare platform 16 by the suspending members 20, and balancers 18, 18 that are provided below the stripper platform 22, that contact the stripper platform 22 that has been lowered together with the pressing plate 12 which has been lowered by driving the cylinder apparatus 10, and that support the stripper platform 22 at a predetermined position.

A first movable plate 24 is provided on a lower surface of the stripper platform 22 so as to be capable of being moved up and down by a cylinder apparatus 26. In addition, a second movable plate 28 is provided on the first movable plate 24 so as to be capable of being moved up and down by a cylinder apparatus 30.

Also, contact platforms 19 that contact the lowered pressing plate 12 are provided on screw rods 17, 17 that extend upward from the flare platform 16.

Figure 2:
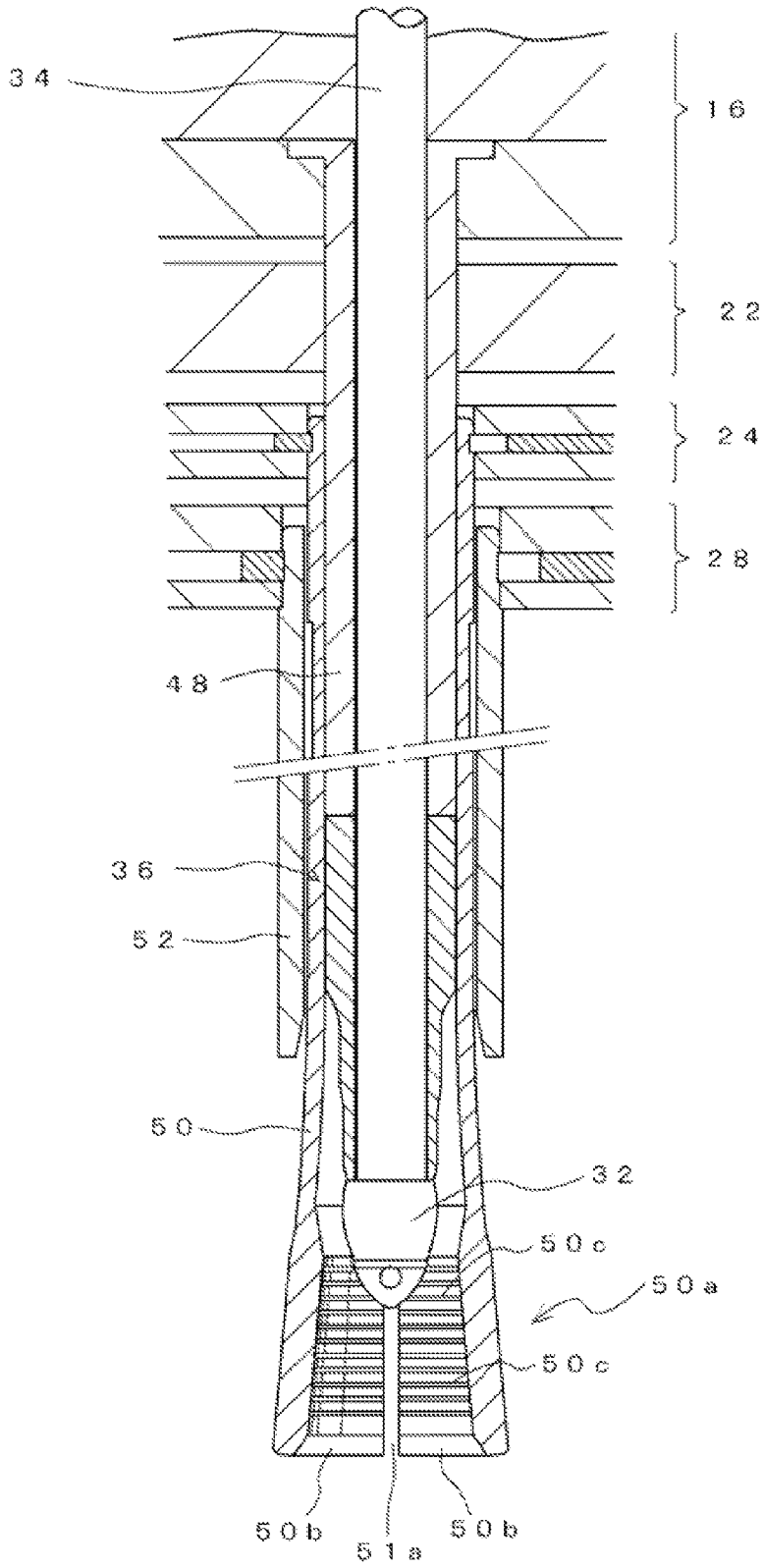
FIG. 2 is a partial cross-sectional view of a chucking apparatus used in the tube expanding apparatus depicted in FIG. 1.

As depicted in FIG. 2, a rear end portion of a mandrel 34, which has a tube expanding billet 32 attached to a front end thereof, is attached to the pressing plate 12.

Figure 3A:
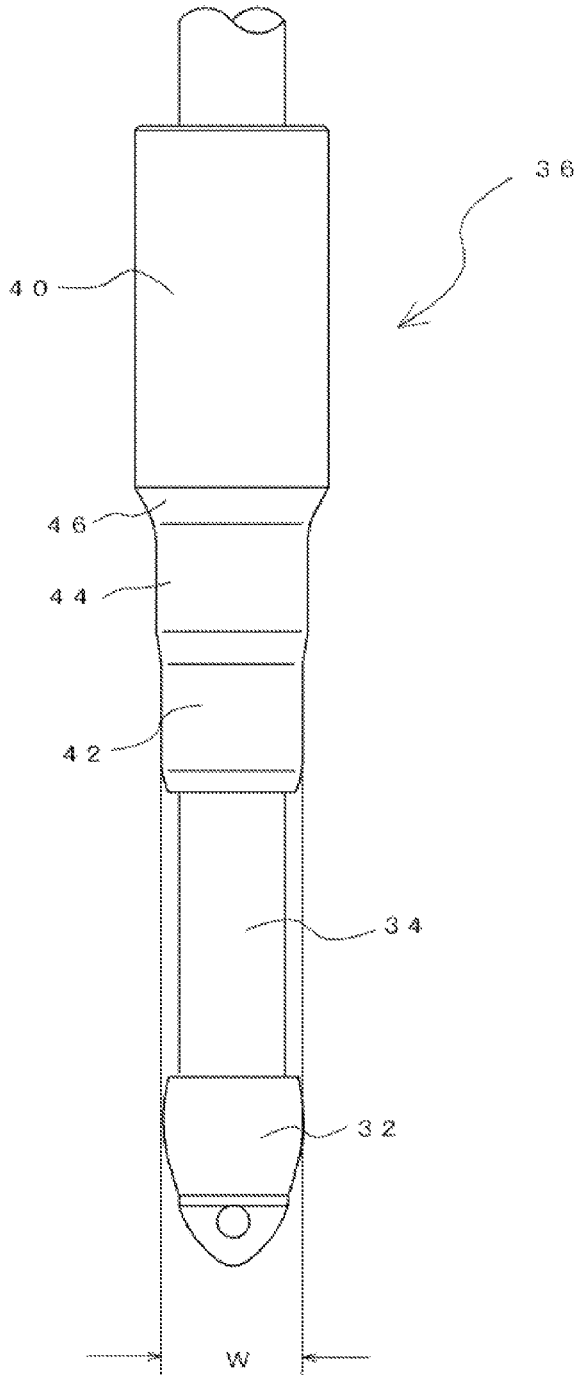
FIGS. 3A and 3B are a front view and a partial cross-sectional view of a flare punch used in the tube expanding apparatus depicted in FIG. 1.
Figure 3B:
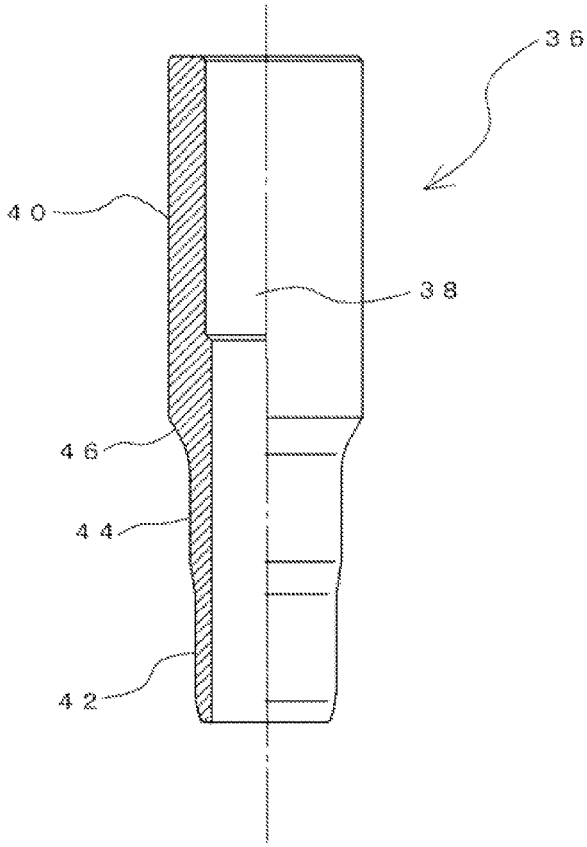

A flare punch 36 is attached to the mandrel 34 so as to be capable of moving up and down along the mandrel 34. As depicted in FIGS. 3A and 3B, the flare punch 36 is a hollow body that has a through-hole 38 formed along a center axis thereof. As depicted in FIG. 3A, the mandrel 34 that has the tube expanding billet 32 attached to the front end thereof is inserted into the through-hole 38.

A guide portion 42 formed with the same outer diameter as the maximum outer diameter W of the tube expanding billet 32 is formed on the front end portion of the flare punch 36. A tapered flare forming portion 46 is formed behind the guide portion 42 between a secondary tube expanding portion 44 that has a larger diameter than the guide portion 42 and the main body 40 that has a larger diameter than the secondary tube expanding portion 44.

As depicted in FIG. 2, a front end surface of a flare socket 48, whose rear end portion is fixed to the flare platform 16, contacts a rear end surface of the flare punch 36. This means that the pressing force of the flare platform 16 is transmitted via the flare socket 48 to the flare punch 36.

Note that by setting the length of the guide portion 42 of the flare punch 36 substantially equal to the length of the secondary tube expanding portion 44, it is possible to facilitate positional adjustments, such as adjustment of tilting of the heat-exchanging tube as described later.

A chucking sleeve 50 that is raised and lowered while making sliding contact with the outer circumferential surface of the main body 40 of the flare punch 36 and the flare socket 48 is provided on the outer circumferential surface of the flare punch 36. A rear end portion of the chucking sleeve 50 is fixed to the first movable plate 24. The chucking sleeve 50 also has a grip portion 50*a* formed on a front end portion thereof.

A plurality of sections 50*b*, 50*b* are formed in the grip portion 50*a* by a plurality of slits 51*a*, 51*a* formed in the length direction of the grip portion 50*a*. The grip portion 50*a* composed of the sections 50*b*, 50*b* is formed in a taper so that the inner diameter thereof gradually widens toward a front end of the grip portion 50*a*.

A plurality of ring-shaped channels 50*c*, 50*c* are formed in an inner wall surface of the sections 50*b* in a direction that is perpendicular to the center axis of the grip portion 50*a* to make it possible to reliably grip a protruding portion of a heat-exchanging tube.

A clamp bushing 52 that is raised and lowered while making sliding contact with the outer circumferential surface of the chucking sleeve 50 is provided on the outer circumferential surface of the chucking sleeve 50. A rear end portion of the clamp bushing 52 is fixed to the second movable plate 28. When the clamp bushing 52 is lowered, the diameter of the tapered grip portion 50*a* of the chucking sleeve 50 is reduced, making it possible to grip the protruding portion of the heat-exchanging tube that has been inserted inside the grip portion 50*a*.

Note that the chucking sleeve 50 and the clamp bushing 52 are capable of being raised and lowered separately by separately driving the cylinder apparatuses 26, 30.

When tube expansion of a heat-exchanging tube is carried out using the tube expanding apparatus depicted in FIG. 1 that is equipped with the chucking apparatus depicted in FIG. 2 and in FIG. 3, a fin layer in which a plurality of U-shaped heat-exchanging tubes have been inserted is set below the first movable plate 24 and the second movable plate 28. This state where the fin layer has been set is depicted in FIG. 4.

A front end portion (hereinafter sometimes referred to as the "protruding portion 56") of a straight part of a heat-exchanging tube 54 protrudes from one side of a fin layer 53 depicted in FIG. 4 and a hairpin-shaped part of the heat-exchanging tube 54 protrudes from the other side of the fin layer 53.

The tube expanding billet 32 and the grip portion 50*a* of the chucking sleeve 50 are positioned above the protruding portion 56 of the heat-exchanging tube 54 that protrudes from one side of the fin layer 53.

Figure 4:
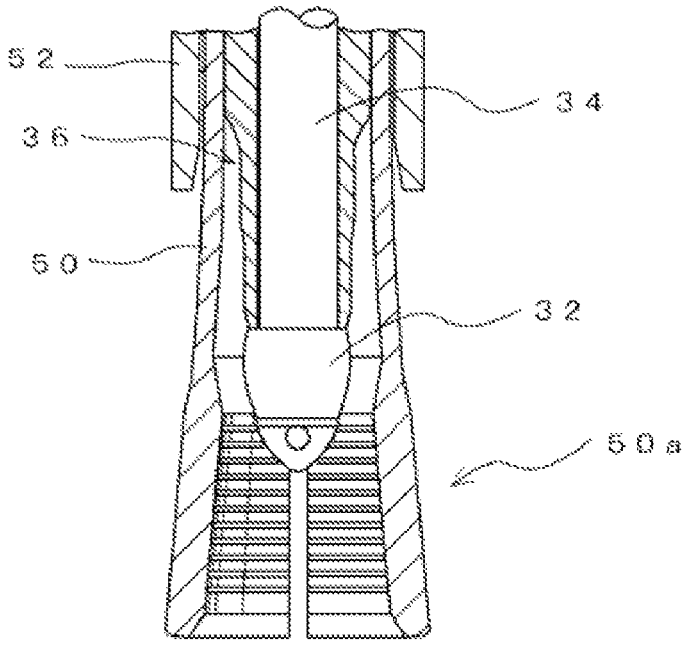
FIG. 4 is a schematic diagram useful in explaining a state before the start of tube expansion of a heat-exchanging tube by the tube expanding apparatus depicted in FIG. 1.
Figure 4:
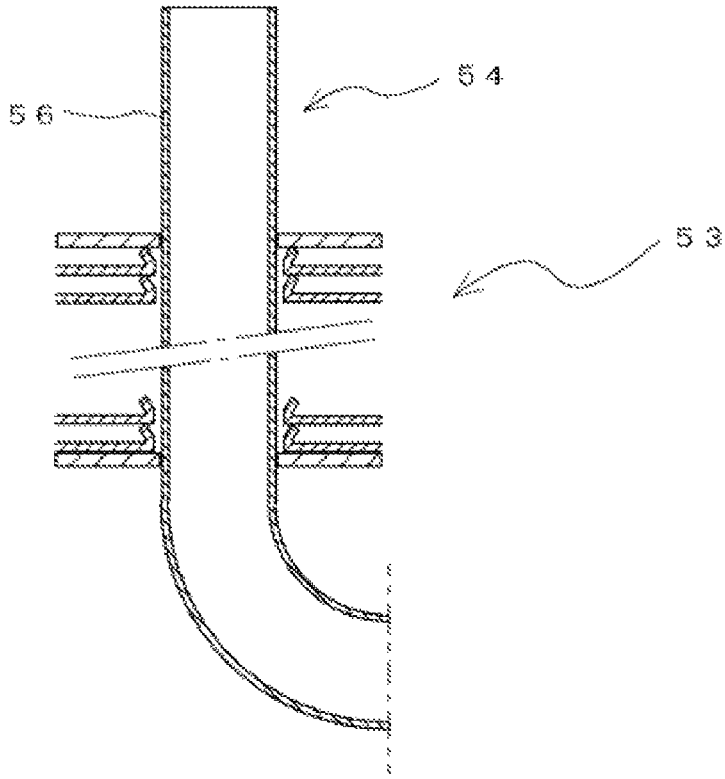

The grip portion 50*a* of the chucking sleeve 50 depicted in FIG. 4 is formed as a tapered grip portion so that the force that squeezes the grip portion 50*a* is released when the clamp bushing 52 is raised.

When the cylinder apparatus 10 is driven and the pressing plate 12 is lowered, the flare platform 16 and the stripper platform 22 will be lowered together with the lowering of the pressing plate 12. When the stripper platform 22 has come into contact with the balancers 18, 18, the lowering of the pressing plate 12 is stopped, and the cylinder apparatuses 26, 30 are driven so that the first movable plate 24 and the second movable plate 28 are lowered.

Figure 5A:
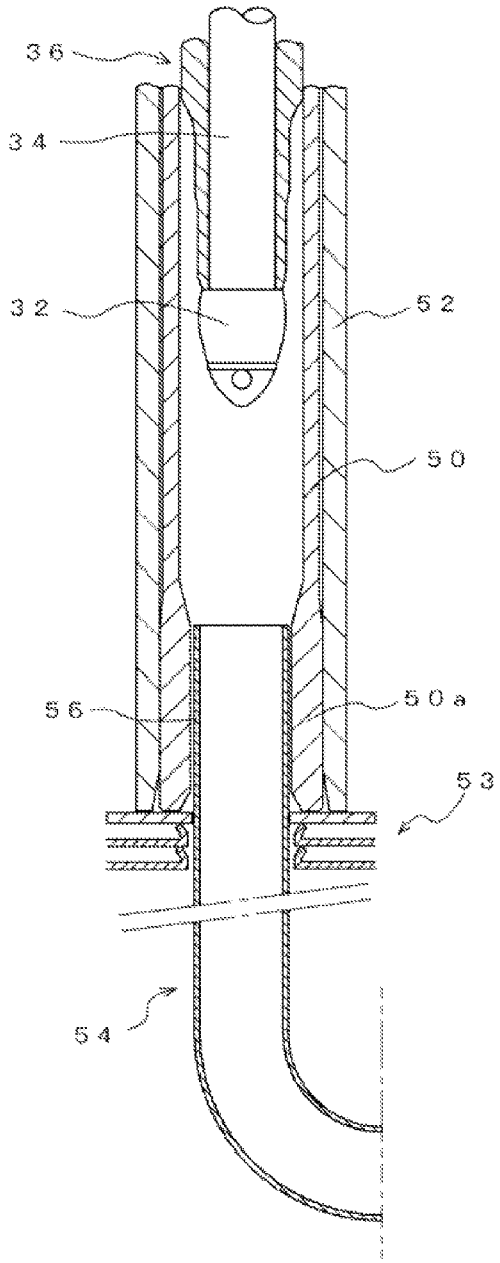
FIGS. 5A and 5B are schematic diagrams useful in explaining states during tube expansion of a heat-exchanging tube by the tube expanding apparatus depicted in FIG. 1.

By lowering the first movable plate 24 and the second movable plate 28, as depicted in FIG. 5A, the chucking sleeve 50 and the clamp bushing 52 are lowered and the yet-unexpanded protruding portion 56 of the heat-exchanging tube 54 is inserted inside the grip portion 50*a* of the chucking sleeve 50 whose diameter has been reduced by the clamp bushing 52.

Note that when the chucking sleeve 50 and the clamp bushing 52 have been lowered, the end surfaces of the chucking sleeve 50 and the clamp bushing 52 will press the end surface of the fin layer 53 and adjust the protruding length of the protruding portion 56 of the heat-exchanging tube 54.

As depicted in FIG. 5A, after the yet-unexpanded protruding portion 56 of the heat-exchanging tube 54 has been inserted inside the grip portion 50*a* of the chucking sleeve 50 whose diameter has been reduced by the clamp bushing 52, the cylinder apparatus 10 is driven and the pressing plate 12 is lowered until the flare platform 16 contacts the stripper platform 22 which has been lowered and stopped in contact with the balancers 18, 18.

Figure 5B:
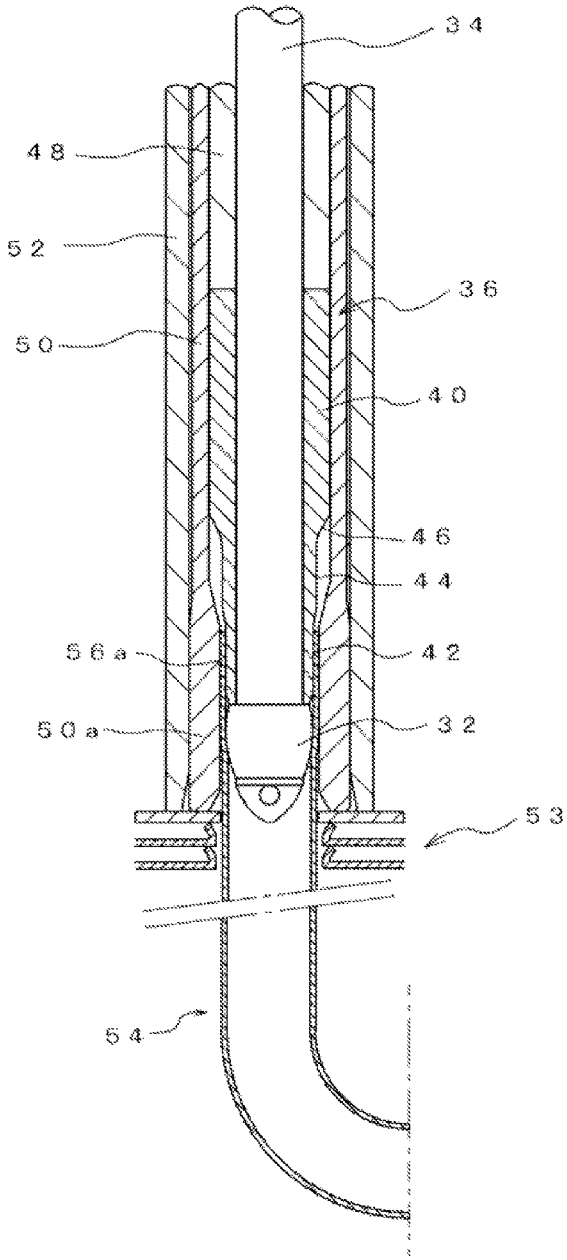

As depicted in FIG. 5B, when the flare platform 16 has come into contact with the stripper platform 22, the tube expanding billet is inserted inside the protruding portion 56 of the heat-exchanging tube 54, and the protruding portion 56 is expanded so as to become the expanded protruding portion 56*a*. The outer circumferential surface of the expanded protruding portion 56*a* is pressed onto the inner wall surface of the grip portion 50*a* of the chucking sleeve 50 and is gripped by the squeezing force of the grip portion 50*a*.

Also, as depicted in FIG. 5B, due to the lowering of the flare platform 16, the guide portion 42 of the flare punch 36 is pressed via the flare socket 48 so as to become inserted inside the expanded protruding portion 56*a*.

The guide portion 42 of the flare punch 36 is formed so as to have the same length as the secondary tube expanding portion 44. By inserting the guide portion 42 into the expanded protruding portion 56*a* of the heat-exchanging tube 54, it is possible to adjust the position of the heat-exchanging tube 54 so as to become vertical, even when the heat-exchanging tube 54 was inserted into the fin layer 53 at an angle.

Figure 6A:
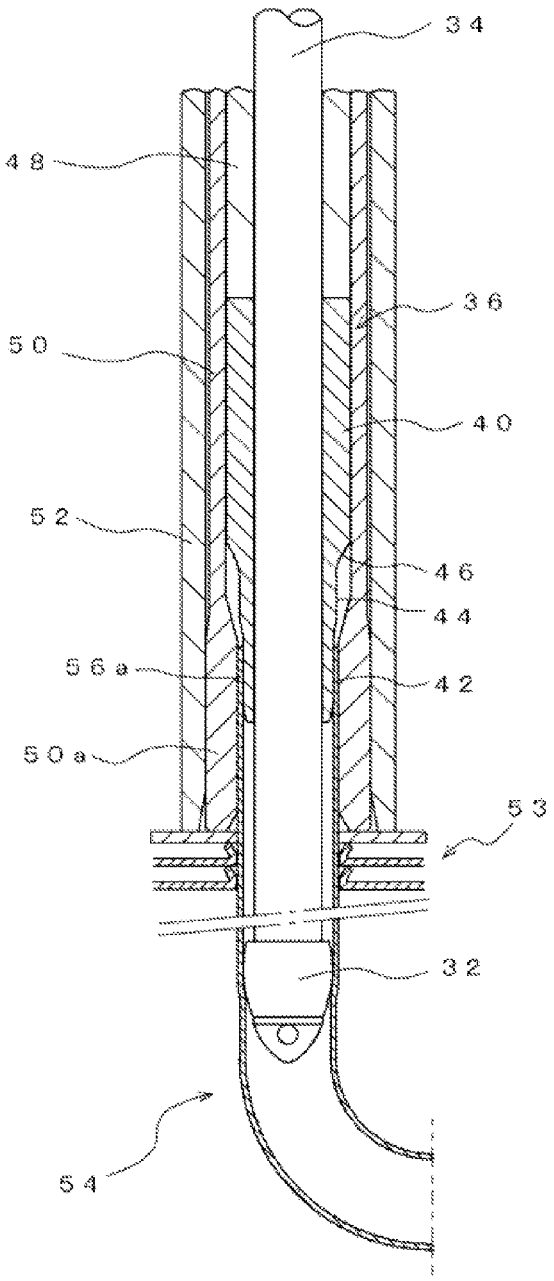
FIGS. 6A and 6B are schematic diagrams useful in explaining states during tube expansion of a heat-exchanging tube by the tube expanding apparatus depicted in FIG. 1.

After this, when the cylinder apparatus 10 is driven and the pressing plate 12 is lowered, in a state where the flare platform 16 and the stripper platform 22 are stopped at the predetermined position by the balancers 18, 18, the tube expanding billet 32 is advanced as depicted in FIG. 6A into a yet-unexpanded part of the heat-exchanging tube 54 to carry out primary tube expansion and integrate the heat-exchanging tube 54 and the fins of the fin layer 53.

When carrying out primary tube expansion, the guide portion 42 of the flare punch 36 is inserted into the expanded protruding portion 56*a* of the heat-exchanging tube 54 so as to support the inner wall surface of the expanded protruding portion 56*a*. This means that it is possible to prevent both reduction in the diameter of the expanded protruding portion 56*a* through which the tube expanding billet 32 has passed due to spring-back and deformation of the expanded protruding portion 56*a* due to the squeezing force of the grip portion 50*a* of the chucking sleeve 50.

Accordingly, it is possible to reliably grip the expanded protruding portion 56*a* of the heat-exchanging tube 54 using the squeezing force of the grip portion 50*a* of the chucking sleeve 50 and to prevent the "avec phenomenon" where fins become tightly attached to one another due to the heat-exchanging tube 54 shrinking in the length direction during the primary tube expansion.

When the pressing plate 12 has been lowered and comes into contact with the contact platforms 19, the tube expansion of the heat-exchanging tube 54 is complete. The driving of the cylinder apparatus 10 is stopped to stop the lowering of the pressing plate 12, and the cylinder apparatuses 26, 30 are driven to raise the first movable plate 24 and the second movable plate 28.

Figure 6B:
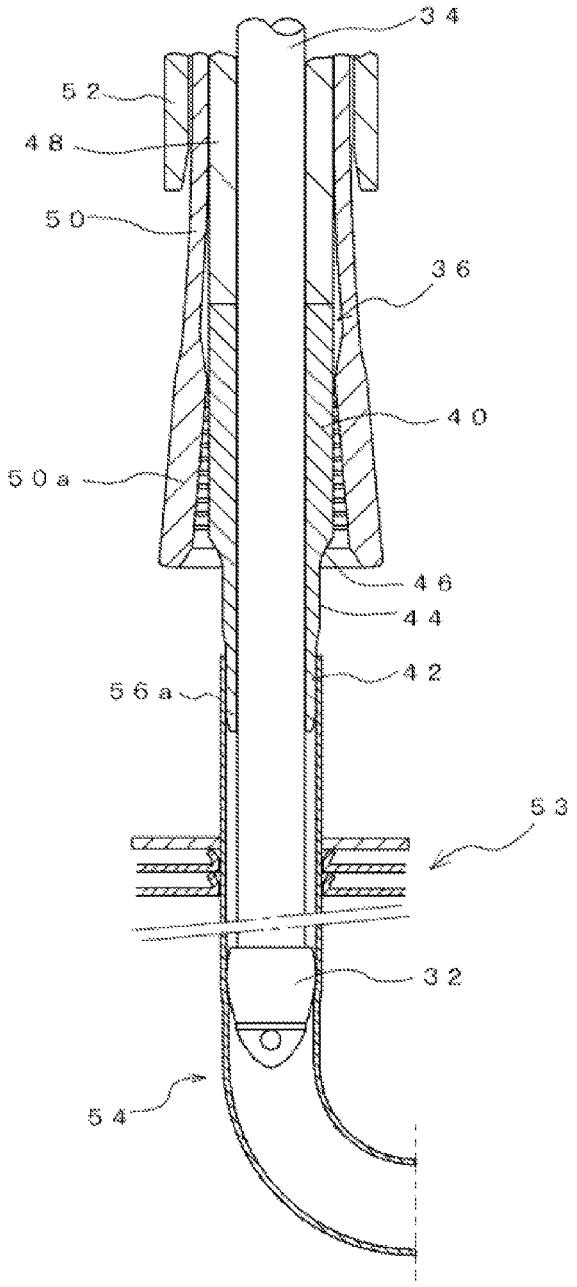

When the first movable plate 24 and the second movable plate 28 are raised, as depicted in FIG. 6B, the clamping of the expanded protruding portion 56*a* of the heat-exchanging tube 54 by the clamp bushing 52 is released, and the chucking sleeve 50 and the clamp bushing 52 are raised, thereby exposing the expanded protruding portion 56*a* of the heat-exchanging tube 54.

Figure 7A:
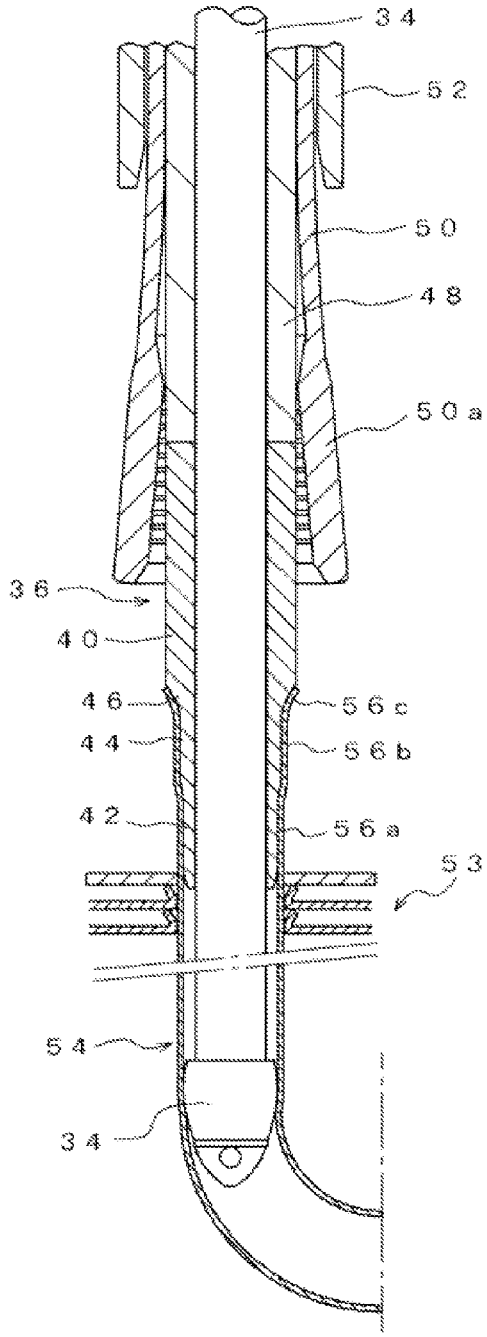
FIGS. 7A and 7B are schematic diagrams useful in explaining states before completion and at completion of tube expansion of a heat-exchanging tube by the tube expanding apparatus depicted in FIG. 1.

Next, when the cylinder apparatus 10 is driven and the pressing plate 12 that is in contact with the contact platforms 19, 19 is pressed downward, a force that presses the flare platform 16 downward against the upward pressing force of the balancers 18, 18 is transmitted via the contact platforms 19 and the screw rods 17, 17, resulting in the flare platform 16 being lowered. Due to the lowering of the flare platform 16, as depicted in FIG. 7A, the front end portion of the flare punch 36 is pressed inside the expanded protruding portion 56. Due to the front end portion of the flare punch 36 being pressed in, it is possible for the secondary tube expanding portion 44 of the flare punch 36 to form a large diameter portion 56*b* that has a larger diameter than the expanded protruding portion 56*a* and for the flare forming portion 46 of the flare punch 36 to form a flare portion 56*c* in the front end portion of the large diameter portion 56*b*.

Figure 7B:
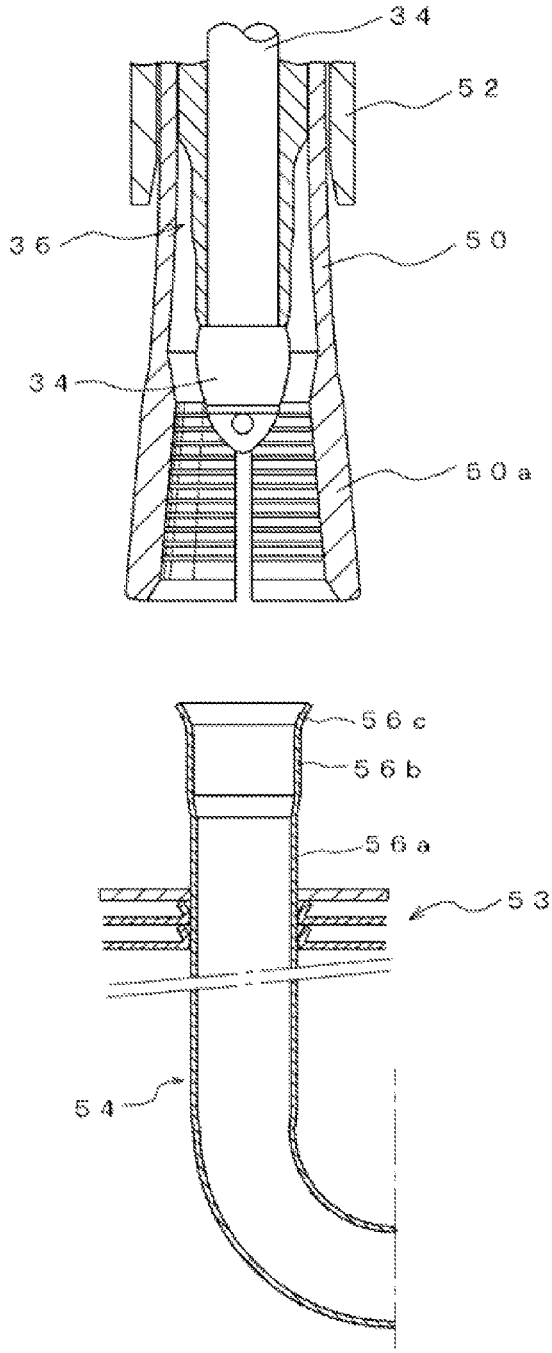
Figure 8:
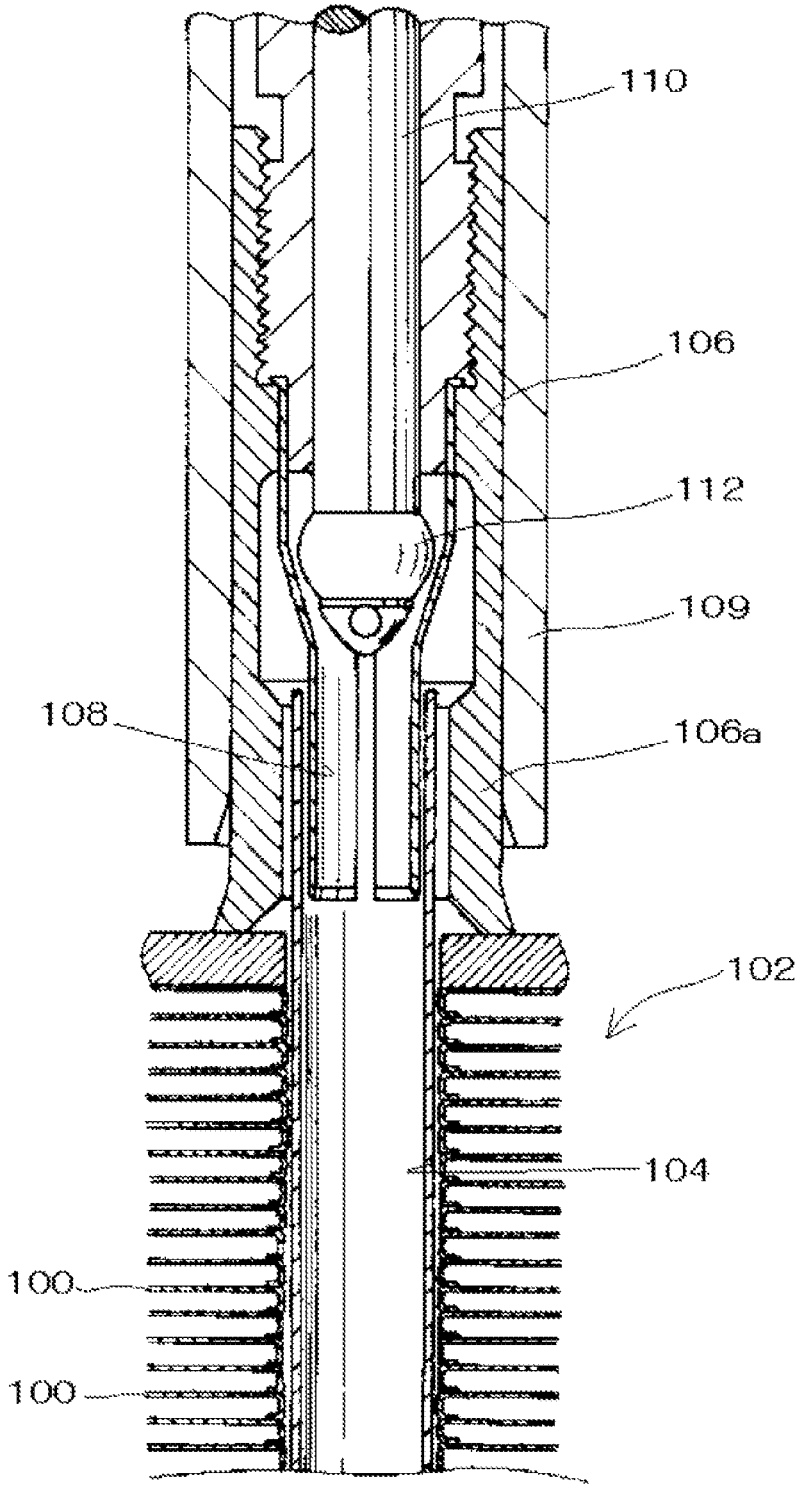
FIG.8 PRIOR ART
FIG. 8 is a partial cross-sectional view useful in explaining a chucking apparatus used in a conventional tube expanding apparatus.

After this, the cylinder apparatus 10 is driven and by raising the pressing plate 12 to a predetermined position, the stripper platform 22 and the flare platform 16 are also raised to predetermined positions, thereby exposing the flare portion 56*c* and the like formed in the front end portion of the heat-exchanging tube 54 as depicted in FIG. 7B. In this state, it is possible to remove the fin layer 53 where the fins have been integrated with the expanded heat-exchanging tube 54.

What is claimed is:

1. A tube expanding apparatus that places an outer circumferential surface of a maximum diameter portion of a tube expanding billet, which has been inserted into a heat-exchanging tube that passes through a fin layer in which a plurality of fins have been stacked, in direct contact with an inner wall surface of the heat-exchanging tube to expand the heat-exchanging tube and thereby integrate the heat-exchanging tube and the fins, the tube expanding apparatus comprising;

a mandrel, which has a tube expanding billet attached to a front end thereof:

a chucking apparatus including:

a chucking sleeve with a grip portion that grips an outer circumferential surface of an expanded protruding portion of the heat-exchanging tube which protrudes from one side of the fin layer and has been expanded by the tube expanding billet, wherein a diameter of the grip portion is capable of being reduced by a squeezing force that acts upon an outer circumferential surface of the grip portion; and a clamp bushing that is provided so as to be capable of sliding along the outer circumferential surface of the chucking sleeve in one of a direction where the grip portion of the chucking sleeve is squeezed so as to grip the expanded protruding portion of the heat-exchanging tube and a direction where squeezing by the grip portion of the chucking sleeve is released to stop the expanded protruding portion from being gripped, wherein the tube expanding apparatus further comprises:

an insertion means that expands the heat-exchanging tube and integrates the fins and the heat-exchanging tube by inserting the tube expanding billet into a yet-unexpanded part of the heat-exchanging tube in a state where the expanded protruding portion of the heat-exchanging tube that has been expanded inside the grip portion of the chucking sleeve whose diameter has been reduced by the clamp bushing is gripped by the grip portion of the chucking sleeve; and a flare punch that is provided so as to be movable along the mandrel and has a flare forming portion formed on a front end portion thereof, the flare forming portion forming a flare portion on the expanded protruding portion of the heat-exchanging tube after gripping by the grip portion of the chucking sleeve has been released in a state where expansion of the heat-exchanging tube by the tube expanding billet has been completed, and wherein a guide portion, which has an equal diameter to the maximum outer diameter of the tube expanding billet and is inserted into the expanded protruding portion of the heat-exchanging tube inside the grip portion of the chucking sleeve so as to support an inner wall surface of the expanded protruding portion, is formed closer to a front end of the flare punch than the flare forming portion.

2. A tube expanding apparatus according to claim 1, wherein when the guide portion of the flare punch has been inserted into the expanded protruding portion of the heat-exchanging tube, a position of the heat-exchanging tube is adjusted so that center axes of the heat-exchanging tube and the flare punch match.

3. A tube expanding apparatus according to claim 1, wherein a secondary tube expanding portion, which carries out secondary tube expansion where the expanded protruding portion of the heat-exchanging tube that has been subjected to primary expansion by the tube expanding billet is expanded further, is formed between the flare forming portion and the guide portion of the flare punch.

4. A tube expanding apparatus according to claim 2, wherein a secondary tube expanding portion, which carries out secondary tube expansion where the expanded protruding portion of the heat-exchanging tube that has been subjected to primary expansion by the tube expanding billet is expanded further, is formed between the flare forming portion and the guide portion of the flare punch.

5. A tube expanding apparatus according to claim 1, wherein the grip portion formed on a front end portion of the chucking sleeve is formed as a tapered grip portion that is formed into a plurality of sections by forming a plurality of slits in a length direction of the grip portion and has an inner diameter that gradually increases toward a front end of the grip portion when the clamp bushing has been slid to release the squeezing of the grip portion.

6. A tube expanding apparatus according to claim 2, wherein the grip portion formed on a front end portion of the chucking sleeve is formed as a tapered grip portion that is formed into a plurality of sections by forming a plurality of slits in a length direction of the grip portion and has an inner diameter that gradually increases toward a front end of the grip portion when the clamp bushing has been slid to release the squeezing of the grip portion.

7. A tube expanding apparatus according to claim 3, wherein the grip portion formed on a front end portion of the chucking sleeve is formed as a tapered grip portion that is formed into a plurality of sections by forming a plurality of slits in a length direction of the grip portion and has an inner diameter that gradually increases toward a front end of the grip portion when the clamp bushing has been slid to release the squeezing of the grip portion.

8. A tube expanding apparatus according to claim 4, wherein the grip portion formed on a front end portion of the chucking sleeve is formed as a tapered grip portion that is formed into a plurality of sections by forming a plurality of slits in a length direction of the grip portion and has an inner diameter that gradually increases toward a front end of the grip portion when the clamp bushing has been slid to release the squeezing of the grip portion.

* * * * *